United States Patent [19]

Neff et al.

[11] 4,265,182

[45] May 5, 1981

[54] DAMPING RAILWAY CAR TRUCK

[75] Inventors: Robert K. Neff, St. Louis; David P. Hillstead, St. Charles, both of Mo.

[73] Assignee: ACF Industries, Inc., New York, N.Y.

[21] Appl. No.: 54,390

[22] Filed: Jul. 2, 1979

[51] Int. Cl.[3] ..... B61D 5/06; B61D 5/10; B61D 5/12; B61D 5/52

[52] U.S. Cl. ..... 105/197 D; 105/182 R; 105/197 DB; 105/197 DP; 267/9 A; 267/9 C

[58] Field of Search ..... 105/182 R, 192, 193, 105/197 R, 197 D, 197 DB, 197 DH, 197 DP; 267/9 A, 9 C

[56] References Cited

U.S. PATENT DOCUMENTS

| | | | |
|---|---|---|---|
| 2,118,006 | 5/1938 | Couch | 105/193 |
| 2,398,621 | 4/1946 | Cottrell | 105/197 D |
| 2,403,352 | 7/1946 | Edstrom | 105/197 D |
| 2,793,029 | 5/1957 | Shafer | 105/197 DP X |
| 2,928,358 | 3/1920 | Meyer | 105/192 |
| 3,006,290 | 10/1961 | Seelig, Jr. | 105/197 D |
| 3,762,694 | 10/1973 | MacDonnell | 105/197 D X |
| 4,030,424 | 6/1977 | Garner et al. | 105/182 R |
| 4,077,496 | 3/1978 | Wiebe | 105/197 DH |

*Primary Examiner*—Randolph A. Reese

*Assistant Examiner*—Howard Beltran

*Attorney, Agent, or Firm*—Henry W. Cummings

[57] ABSTRACT

In a railway car truck a lower transom extends between transversely spaced side frames. The side frames include depressed portions having transversely aligned vertical openings or slots which receive spring groups. A bolster including a center connection extends between the side frames above the transom and rests on the spring groups. The side frames each include a hollow post extending upwardly between the spring groups. The bolster includes a depending post which surrounds the side frame post. A friction damping assembly including upper and lower wedges is located within the side frame post and the bolster post. The upper and lower wedges include rear wear plates which engage the side frame post. The upper and lower wedges include an opening to receive a spring extending upwardly from the side frame depressed portion. The lower wedge has at least one inclined surface which slidingly engages at least one inclined surface on the upper wedge. The upper surface of the upper wedge engages the lower surface of the bolster. Oscillations of the spring group and bolster are damped by the rear wear surfaces forced outwardly by the inclines of the upper and lower wedges as the bolster moves downwardly with respect to the side frames.

6 Claims, 16 Drawing Figures

DAMPING RAILWAY CAR TRUCK

BACKGROUND OF THE INVENTION

In U.S. Pat. No. 4,030,424 assigned to the same assignee as the present application, a railway car truck is disclosed having a pair of transversely spaced side frames joined by a transverse plate rigidly connected to the lower portion of each side frame to maintain the truck in tram. A bolster including a center bearing extends between the side frames and rests upon spring groups located in vertical slots in the side frames. The weight of the car body is taken on the bolster above the spring groups.

SUMMARY OF THE INVENTION

The object of the present invention is to provide an improved friction damping assembly for a railway car truck, particularly of the type described in U.S. Pat. No. 4,030,424.

In a railway car truck, transversely spaced side frames include transversely aligned depressed portions having vertical openings or slots which receive spring groups. A bolster including a center connection extends between the side frames and rests on the spring groups. The side frames each include a hollow post extending upwardly between the spring groups. The bolster includes a depending post which surrounds the side frame post. A friction damping assembly including upper and lower wedges is located within the side frame post and the bolster post. The upper and lower wedges include rear wear plates which engage the side frame post. The upper and lower wedges include an opening to receive a spring extending upwardly from the side frame depressed portion. The lower wedge has at least one inclined surface which slidingly engages at least one inclined surface on the upper wedge. The upper surface of the upper wedge engages the lower surface of the bolster. Oscillations of the spring group and bolster are damped by the rear wear surfaces forced outwardly by the inclined surfaces of the upper and lower wedges as the bolster moves downwardly with respect to the side frames.

Preferably the upper and lower wedges each include a pair of laterally spaced inclined surfaces which abut in operation. Wear plates are preferably provided on the interior surface of the side frame post.

This damping unit is believed to be superior to conventional friction units because it is more compact and because it requires less springs for the same force output.

THE DRAWINGS

FIG. 1 is a partial plan view of the bolster and spring assembly of the present invention with the springs removed for clarity;

FIG. 1*a* is a schematic plan veiw of the transom and side frames in the truck assembly of the present invention;

FIG. 1*b* is a front elevation view of FIG. 1*a*;

DESCRIPTION OF PREFERRED EMBODIMENTS

Figure 5:
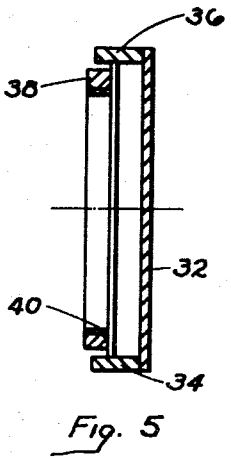
FIG. 5 is a sectional view looking in the direction of the arrows along the line 5—5 in FIG. 1.

The railway car truck of the present invention is indicated in the drawings generally at 10. The truck includes a pair of spaced side frames 12 and 14. A lower transom 16 and a bolster 18 extend between the side frames. The transom 16 is described in Ser. No. 033,647 filed Apr. 26, 1979. In general, this transom includes a pair of tubes 20 and 22 welded to respective side frames 12 and 14. A bearing member 24 extends within one of the tubes 20 and is welded thereto. A collar 26 is welded to the other tube and bearing surface 28 extends within the collar 26. Relative rotation can occur between collar 26 and bearing 24 along surface 28 as the side frames rock in vertical planes about a transverse axis.

Figure 3:
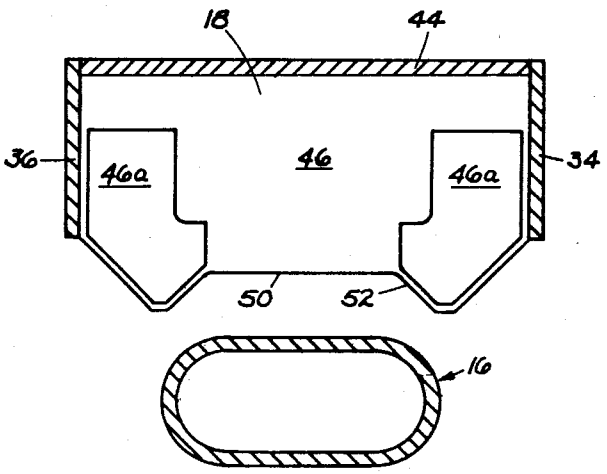
FIG. 3 is a sectional view looking in the direction of the arrows along the line 3—3 in FIG. 2.
Figure 14:
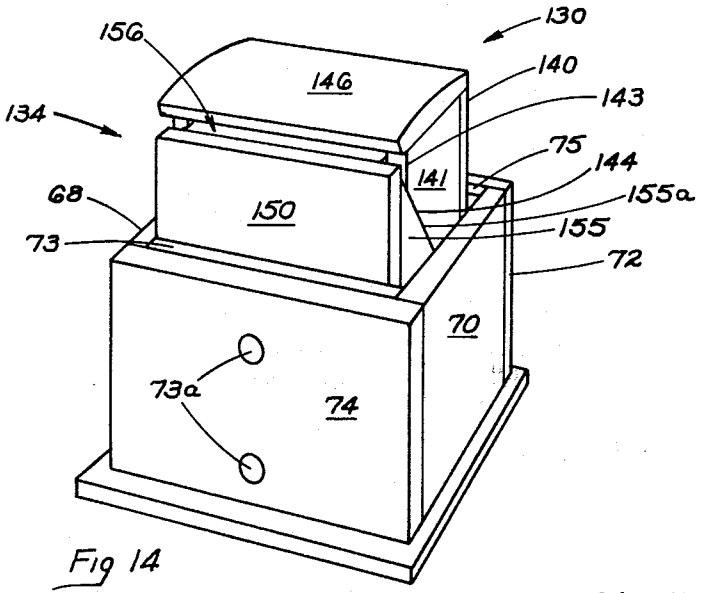
FIG. 14 is a perspective view of the wedges in place within the side frame box.

Bolster 18 is made up of an upper cover plate 30 and a lower cover plate 32. Side cover plates 34 and 36 (FIG. 3) join the upper and lower cover plates. A center bearing 38, including a wear ring 40, and a center pin opening 42 are provided in the bolster. Cover plate 30 extends upwardly at 44 and a transverse stop plate 46 is welded to side plates 34 and 36. This plate is supported by gussets 47 and 48. Wear plates 46*a* are welded to transverse stop plate 46. As shown in FIG. 3 the bolster is cut out at the bottom to form a slot 50 to avoid contact with the transom 16.

Figure 2:
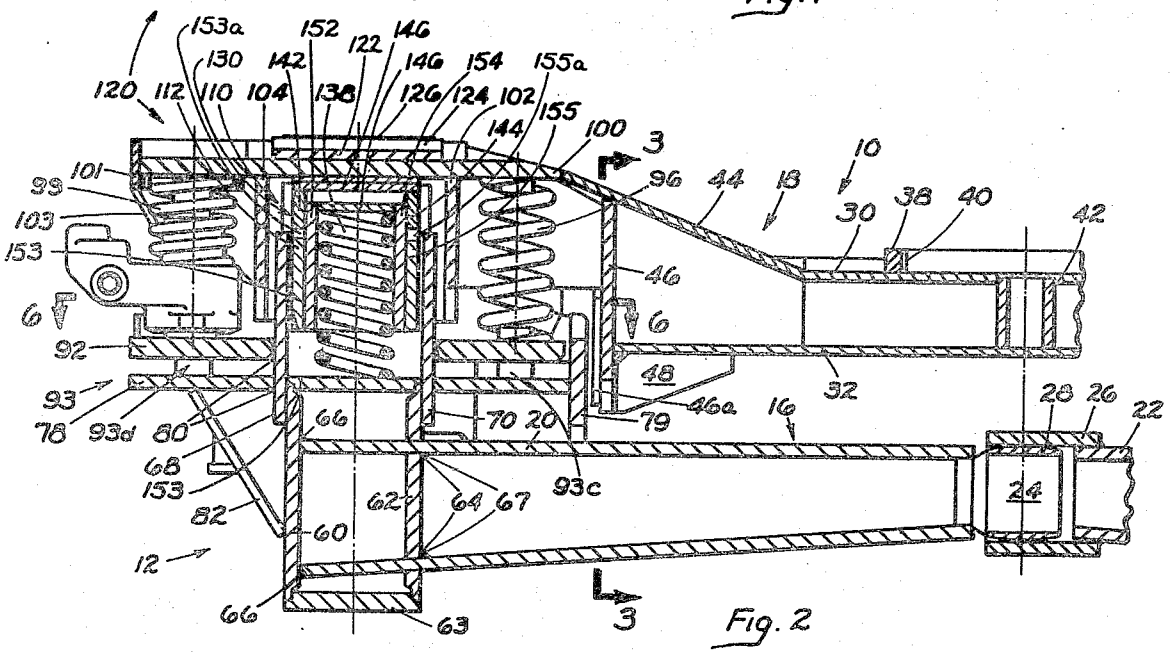
FIG. 2 is a partial sectional view looking in the direction of the arrows along the line 2—2 in FIG. 1 illustrating the bolster, transom, side frame and spring assembly of the present invention.

One of the side frames 12 and 14 is illustrated in FIG. 2, and is constructed of vertical webs 60 and 62 and a bottom cover plate 63. Opening 64 is provided in vertical web 62 through which the end portion 20 of transom 16 extends. Transom 16 is welded to vertical web 60 at 66 and to vertical web 62 at 67.

Figure 6:
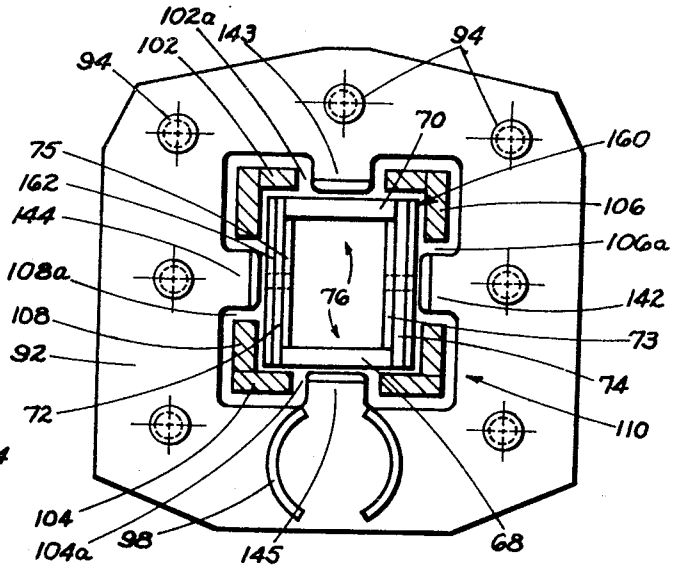
FIG. 6 is a sectional view looking in the direction of the arrows along the line 6—6 in FIG. 2, and rotated 90 degrees, particularly illustrating the spring plate in the spring assembly of the present invention with the wedges removed.
Figure 9:
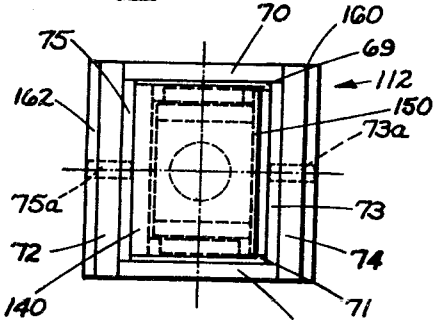
FIG. 9 is a plan view of the damping assembly of the present invention.

A pair of side frame extensions 68 and 70 are welded to side frame vertical webs 60 and 62. In addition, a pair of vertical plates 72 and 74 are welded to plates 68 and 70 on either end (FIG. 6). It will be apparent that the four plates, 68 and 70, 72 and 74, define a rectangular box or post indicated generally in the drawings at 76. In addition, wear plates 73, 75, 160, 162 attached to plates 72 and 74 with fasteners 73*a* and 75*a* (FIG. 9). A horizontal plate 78 (FIG. 2) having an opening 80 extends within the box and is welded to the four plates 68, 70, 72 and 74. Gussets 82 are provided to reinforce horizontal plate 78. A vertical stop plate 79 is welded to the inner end of plate 78 which abuts wear plates 46*a* to prevent undue lateral movement of bolster 18.

Figure 1A:
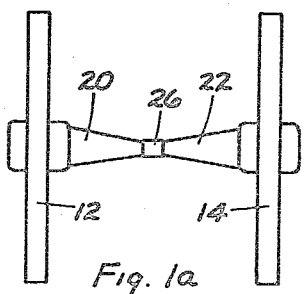
Figure 1B:
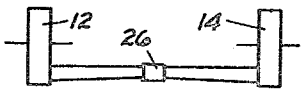
Figure 1:
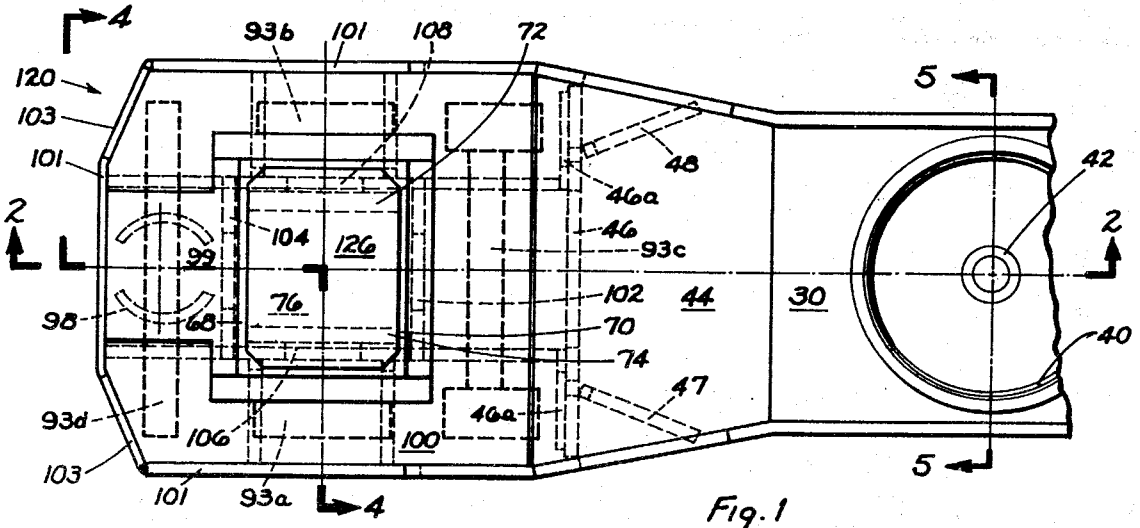
Figure 4:
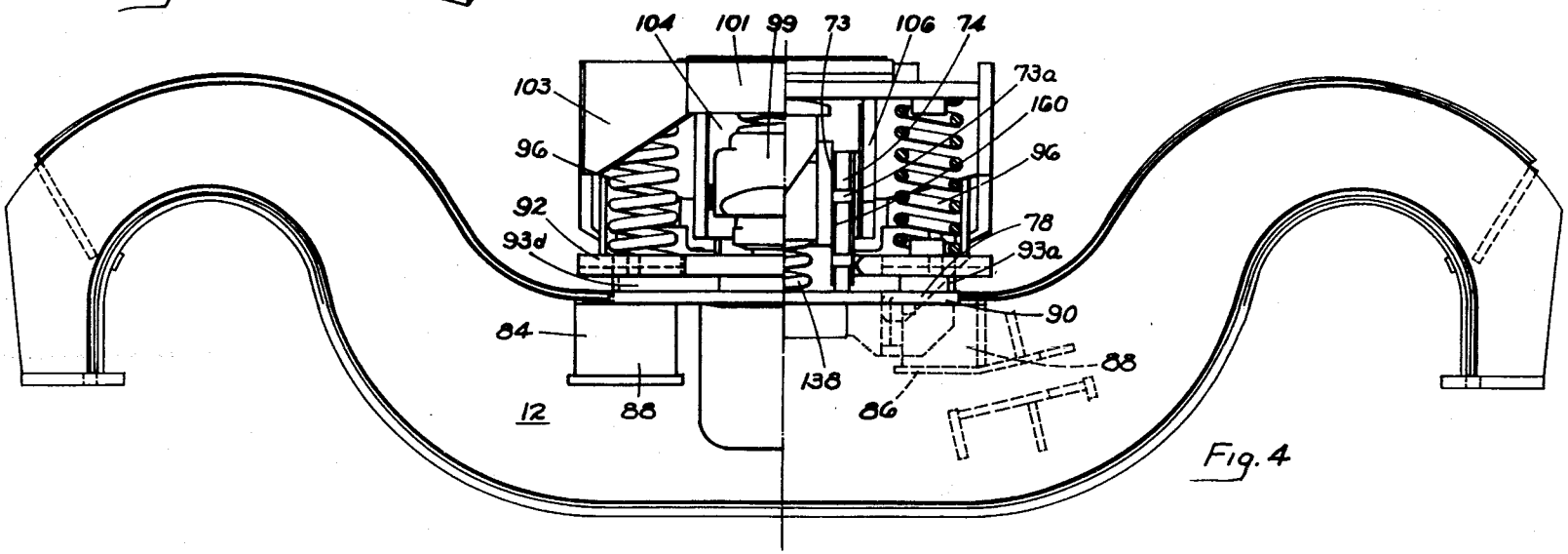
FIG. 4 is a side elevation view of the side frames and bolster assembly of the present invention looking in the direction of the arrows 4—4 in FIG. 1.
Figure 7:
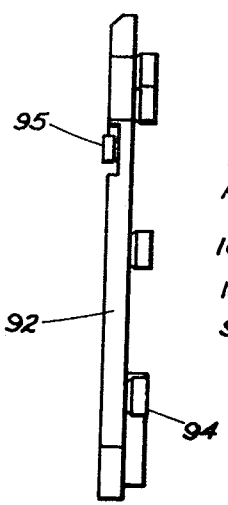
FIG. 7 is a side elevation view of FIG. 6.
Figure 8:
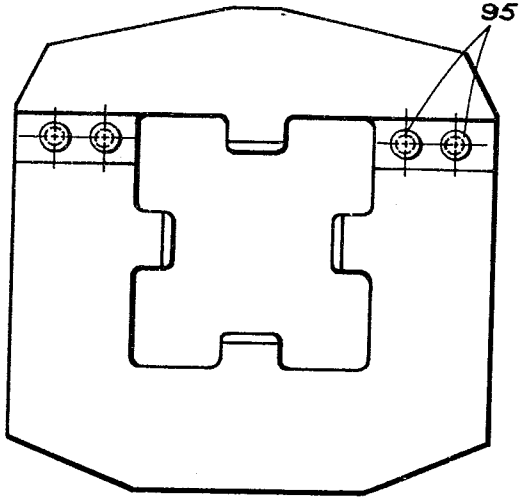
FIG. 8 is a bottom view of FIG. 6.

Longitudinally spaced pockets 84 and 86, or spring housings, are formed in side frames 12 (FIG. 4). Located within spring housings 84 and 86 are rough track springs 88. See U.S. Pat. No. 4,030,424, hereby incorporated into this application by reference, particularly Cols. 7 and 8. These springs extend vertically up through openings 90 in horizontal plate 78. Resting upon rough track springs 88 is a spring plate 92 (FIGS. 2 and 6). As shown in FIGS. 7 and 8, upper guides or spring connectors 95 are provided for rough track springs 88. Mounted upon the upper surface of spring plate 92 are a series of truck spring bases or connectors 94 (FIGS. 6 and 7). These spring connectors are adapted to receive conventional truck springs 96. In addition to the truck springs 96, a base or guide 98 is mounted upon plate 92 and is adapted to receive an optional damper 99 (FIGS. 1 and 2) for the springs 96. This damper may be of known construction of hydraulic type as illustrated, or friction type. A spacer assembly 93 including a plurality of horizontally extending spacers 93*a*, 93*b*, 93*c* and 93*d* (FIG. 4) are provided on plate 78. In normal position spring plate 92 is bottomed out on spacer assembly 93.

Bolster cover plate 44 is welded to a horizontal bolster top plate 100 (FIG. 2). Bolster 100 includes depending housing plates 101 and inclined housing plates 103 (FIG. 2) which maintain in place and prevent the escape of truck springs 96 and damper 99.

Depending from the bolster top plate are four vertical plates 102, 104, 106 and 108. Depending plates 102, 104, 106 and 108 define a bolster post indicated generally at 110. Cut-outs 102*a*, 104*a*, 106*a* and 108*a* are provided in bolster post 110 to receive lugs 142–145 provided on spring plate 92 as shown in FIG. 6.

It will be apparent that the bolster post 110 surrounds the side frame post 76. Extending within posts 76 and 100 is a friction damper indicated generally at 112. Friction damper assembly 112 includes an upper wedge member 130 which engages bolster top plate 100.

Figure 11:
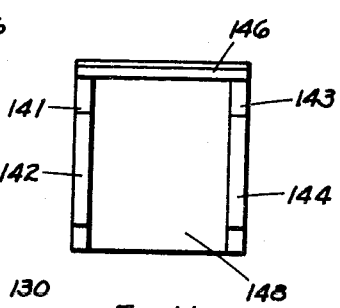
FIG. 11 is a front elevation view of FIG. 10.
Figure 10:
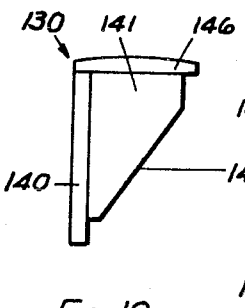
FIG. 10 is a side elevation of the upper damping member of the present invention with the bolster box removed.

Upper wedge member 130 (FIGS. 10 and 11) includes a rear wear plate 140. A pair of laterally spaced plates 141 and 143 extend outwardly from rear wear plate 140, which have respective inclined surfaces 142 and 144. A cover plate 146 joins rear plate 140 and plates 141 and 143. A cavity 148 is thus defined by rear wear plate 140, plates 141 and 143, and top plate 146.

Figure 13:
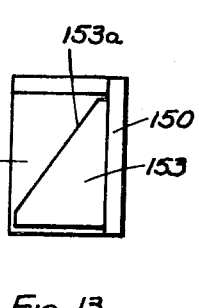
FIG. 13 is a side elevation view of the lower damping member.
Figure 12:
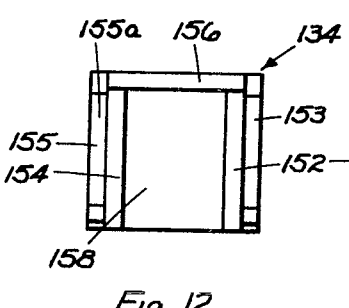
FIG. 12 is a front elevation view of the bottom damping member.

Lower wedge member 134 (FIGS. 12 and 13) includes a rear wear plate 150 and a pair of laterally spaced plates 154, 152, 153 and 155, extending outwardly from rear plate 150, having respective inclined surfaces 153*a* and 155*a*.

An opening 158 is defined by top plate 156 and plates 154 and 152. Spring 138 extends into opening 158. As shown in FIG. 2, spring 138 at its lower portion is mounted upon side frame plate 78.

Thus in operative position spring 138 extends within lower wedge 134 and urges the upper surface thereof 146 upwardly. Lower wedge member 134 and spring 138 (FIG. 2) extend within opening 148 in upper wedge member 130, and respective inclined surfaces of lower wedge members 153*a* and 155*a* abut the inclined surfaces 142 and 144 of upper wedge member in assembled position.

Rear plate 140 of wedge member 130 engages wear plate 75 of post 76. Rear plate 150 of wedge member 134 engages a wear plate 73 mounted on vertical plate 74 of post 76.

Under normal circumstances the car body rests upon a car body bearing assembly indicated generally at 120. This car body bearing assembly is similar to the bearing assembly described in U.S. Pat. No. 4,030,424 which is hereby incorporated into the present application by this reference. Briefly, this bearing assembly includes a rubber member 122 mounted upon bolster plate 100. A car body bearing member 124 is mounted upon the rubber member and includes a bearing surface of low friction material 126.

Normally with the car body resting upon the car body bearing assembly 120, rough track springs 88 are depressed sufficiently for plate 92 to bottom out on spacer assembly 93. Under these circumstances, rough track springs 88 are inoperative. However, when rough track is traversed and side frame 12 goes through a dip in the track, rough track springs 88 come into effect. These springs urge plate 92 upwardly from spacer assembly 93. Furthermore, these springs transmit the weight of the car body down from the bolster and into the side frames to prevent a derailment. Reference may again be made to U.S. Pat. No. 4,030,424 for a more detailed description of the rough track spring operation.

In the operation of friction damper assembly 112, truck springs 96 oscillate as the car body and bolster move up and down relative to side frames 12 and 14. These oscillators are damped during downward movement of the bolster by damper assembly 112. Surfaces 142 and 144 of upper wedge 130 engage lower wedge surfaces 153*a* and 155*a*. Rear plates 140 and 150 of supportive wedges 130 and 134 engage wear plates 73 and 75.

Additional damping may also be provided by optional damper 99, if it is included in the spring assembly.

As wear surfaces 142, 144, 153*a*, 155*a*, 140 or 150 become worn, either or both of the wedges may be replaced. In addition, it may be periodically necessary to replace wear plates 73 and 75 in side frame post 76.

What is claimed is:

1. A railway car truck comprising: transversely spaced side frames, said side frames including centrally depressed portions having transversely aligned vertical slots which receive a plurality of truck spring groups and side frame stop means located inboard of said depressed portions, a bolster including a center connection extending between the side frames and resting on the spring groups; said side frames including a hollow post extending upwardly between the spring groups; said bolster including a depending post which surrounds and is exterior to the upper portion of the side frame post, and bolster stop means which abut said side frame stop means to control lateral movement of the bolster relative to the side means; said bolster stop means being spaced from said side frame stop means a distance sufficient to allow significant relative movement between the bolster and the side frames; a friction damping assembly including upper and lower wedges located within the side frame post; said lower wedge including an opening to receive a spring extending upwardly from said depressed portion of said side frame and extending into said upper wedge; said lower wedge including at least one inclined wear surface which interacts with and slidingly engages at least one wear surface on said upper wedge which is superimposed on the lower wedge wear surface; the upper wedge having an upper surface engaging a lower surface of the bolster whereby oscillations of said spring groups and bolster are damped by abutting surfaces of the lower wedges and side frame posts, increasing damping force as the bolster moves downwardly.

2. A railway car truck according to claim 1 wherein said upper and lower wedges each include a pair of laterally spaced inclined surfaces which abut in assembled position.

3. A railway car truck according to claim 2 including a pair of laterally spaced wear plates attached to laterally spaced surfaces of said side frame post which in operative position engage said upper and lower wedge plates.

4. A railway car truck according to claim 2 wherein said spring group includes a damper which supplements the damping of said wedges.

5. A railway car truck according to claim 2 wherein said upper wedge comprises a rear wear plate, a cover plate and a pair of plates extending outwardly from said rear plate, each having an inclined surface thereon.

6. A railway car truck according to claim 5 wherein said lower wedge comprises a rear wear plate, a cover plate and a pair of plates extending outwardly from said rear plate, each having an inclined surface thereon.

* * * * *